US005769249A

United States Patent [19]

Lascara

[11] Patent Number: 5,769,249

[45] Date of Patent: Jun. 23, 1998

[54] STORAGE RACK BEAM HAVING ROLLED, INTERMEDIATE SECTION WITH UPTURNED, DECK-SUPPORTING EDGE AND WITH INCLINED, INDICIA-RECEIVING SURFACE

[75] Inventor: Linda P. Lascara, Goodlettsville, Tenn.

[73] Assignee: Unarco Material Handling, Inc., Springfield, Tenn.

[21] Appl. No.: 767,197

[22] Filed: Dec. 16, 1996

[51] Int. Cl.[6] ..... A47B 57/00

[52] U.S. Cl. ..... 211/191; 211/182

[58] Field of Search ..... 108/187, 107, 108/110; 211/182, 183, 191, 189, 208

[56] References Cited

U.S. PATENT DOCUMENTS

| | | | |
|---|---|---|---|
| 3,587,483 | 6/1971 | Konstant | 211/191 |
| 4,064,996 | 12/1977 | Skillum | 211/191 |
| 4,074,812 | 2/1978 | Skubic et al. | 211/191 |
| 4,239,100 | 12/1980 | Corey | 193/35 R |
| 5,279,430 | 1/1994 | Benton | 211/151 |
| 5,350,074 | 9/1994 | Rosenband | 211/191 |
| 5,360,122 | 11/1994 | Benton | 211/151 |
| 5,368,174 | 11/1994 | Clark et al. | 211/173 |
| 5,492,231 | 2/1996 | Clark | 211/183 |

*Primary Examiner*—Peter M. Cuomo
*Assistant Examiner*—Gerald A. Anderson
*Attorney, Agent, or Firm*—Rockey, Milnamow, & Katz, Ltd.

[57] ABSTRACT

In a storage rack, in which each of two columns has an outer wall facing outwardly and a side wall facing the side wall of the other column, a steel beam including two flange sections and an intermediate section extends between and is supported by the columns. Being fastened to an associated column, each flange section has a side plate adjacent to the side wall of the associated column and an outer flange adjacent to the outer wall of the associated column. Extending horizontally between the flange sections, the intermediate section is welded at each of its opposite ends to the side flange of an associated one of the flange sections. Being rolled from a steel sheet and defining a downwardly opening channel profile, the intermediate section has an outer wall, an inner wall joined unitarily to the outer wall so as to define an upper edge of the intermediate section, and a lower flange extending inwardly from a lower portion of the inner wall and having an upturned edge. As supported by and on the upturned edge of the lower flange of the intermediate section, a deck is confined against outward movement by the inner wall of the intermediate section and against side-to-side movement by the side plates of the flange sections.

8 Claims, 2 Drawing Sheets

STORAGE RACK BEAM HAVING ROLLED, INTERMEDIATE SECTION WITH UPTURNED, DECK-SUPPORTING EDGE AND WITH INCLINED, INDICIA-RECEIVING SURFACE

TECHNICAL FIELD OF THE INVENTION

This invention pertains generally to a support beam for a storage rack and particularly to a support beam having two flange sections and an intermediate section. Each flange section has a side plate and an outer flange. Being welded to the side plates, the intermediate section is rolled from a steel sheet and defines a downwardly opening channel. If a deck is supported by and on an upturned edge of a lower flange of the intermediate section, the deck is confined against outward movement by an inner wall of the intermediate section and against side-to-side movement by the side plates. Being adapted to receive indicia via labelling or stencilling, an outer wall of the intermediate section may be inclined so as to extend downwardly and outwardly in a preferred embodiment or so as to extend downwardly and inwardly in an alternative embodiment.

BACKGROUND OF THE INVENTION

As exemplified in Clark U.S. Pat. No. 5,368,174, it is known for a support beam for a storage rack to have a tubular profile, as rolled from a steel sheet and provided with a welded seam or as rolled from two steel sheets and provided with two welded seams, and to have two end flanges welded to the support beam. The tubular profile defines a ledge, which opens upwardly and inwardly, which has a vertical wall and a horizontal wall, and which is arranged to support a wooden or steel deck or spaced wooden or steel braces on the horizontal wall. The vertical wall confines such a supported deck or such supported braces against outward movement. The end flanges confine such a supported deck against side-to-side movement. In some disclosed embodiments, the tubular profile defines an inclined, indicia-receiving surface.

As exemplified in Benton U.S. Pat. No. 5,279,430, it is known for a front or rear beam of a storage rack to be rolled from a steel sheet so as to define a downwardly opening channel profile, which forms a wire track. Because the wire track extends across at least two adjacent bays, the front or rear beam is not provided with any end flanges similar to the end flanges disclosed in Clark U.S. Pat. No. 5,368,174. Rather, the front or rear beam is secured onto side beams of the storage rack, via interengaging structures on the front or rear beam and on the side beams. Roller tracks and lane dividers are secured to the front or rear beam, via an upturned, lower, notched flange of the front or rear beam.

Storage rack beams of related interest, which are rolled from steel sheets so as to define open channel profiles and which have notched flanges for securing roller tracks, are exemplified in Corey U.S. Pat. No. 4,239,100.

This invention has resulted from efforts to provide, for a storage rack, a beam section that could be effectively rolled from a steel sheet, that would not require a welded seam extending along the beam section, that would support a deck, and that could have an inclined, indicia-receiving surface.

SUMMARY OF THE INVENTION

This invention contemplates that a storage rack comprises two steel columns and a steel beam. Each such column has an outer wall facing outwardly and a side wall facing the side wall of the other column. The beam extends between and is supported by the columns and includes two flange sections and an intermediate section.

Being fastened to an associated one of the columns, each flange section has a side plate adjacent to the side wall of the associated column and an outer plate adjacent to the associated column. Extending horizontally between the flange sections, the intermediate section is welded at each of its opposite ends to the side flange of an associated one of the flange sections.

Being rolled from a steel sheet, the intermediate section has a generally vertical wall and a lower flange extending inwardly and upwardly from a lower portion of the inner wall. The lower flange has an, upturned edge spaced below the upper edge of the intermediate section.

According to this invention, the upturned edge provides means for supporting a deck on the upturned edge, between the side plates and behind the generally vertical wall. Moreover, the generally vertical wall provides means for confining such a supported deck against outward movement. Furthermore, the side plates provide means for confining such a supported deck against side-to-side movement.

Preferably, as rolled from a steel sheet, the intermediate section has an outer wall and an inner wall, which is the generally vertical wall and which is joined unitarily to the outer wall so as to define the upper edge of the intermediate section.

Preferably, the outer wall of the intermediate section is inclined so as to extend downwardly and outwardly and so as to define an expansive surface facing upwardly and outwardly. The expansive surface is adapted to receive indicia via labelling or stencilling. The outer wall of the intermediate section may have a lower flange extending inwardly from the inclined portion.

Alternatively, the outer wall of the intermediate section is inclined so as to extend downwardly and inwardly and so as to define an expansive surface facing downwardly and outwardly. The expansive surface is adapted to receive indicia via labelling or stencilling.

These and other objects, features, and advantages of this invention are evident from the following description of a preferred embodiment of this invention, with reference to the accompanying drawings.

DETAILED DESCRIPTION OF THE PREFERRED EMBODIMENT

Figure 1:
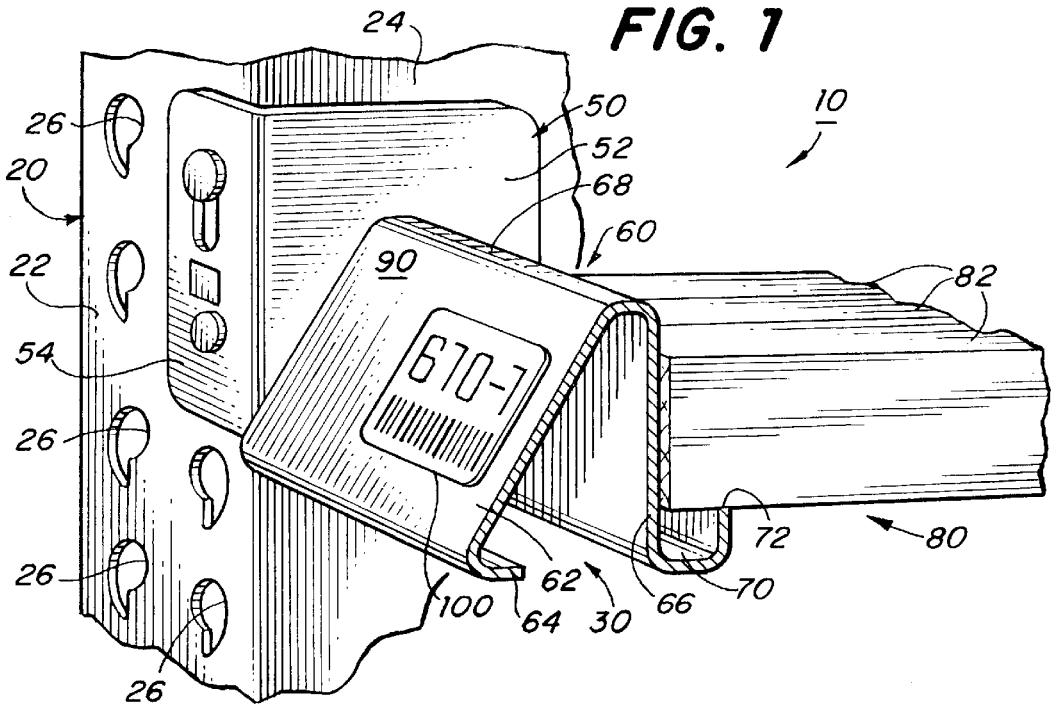
FIG. 1 is a fragmentary, perspective view of a front column, one flange structure of a support beam, an intermediate structure of the support beam, and a wooden deck, as utilized in a storage rack constituting a preferred embodiment of this invention.
Figure 2:
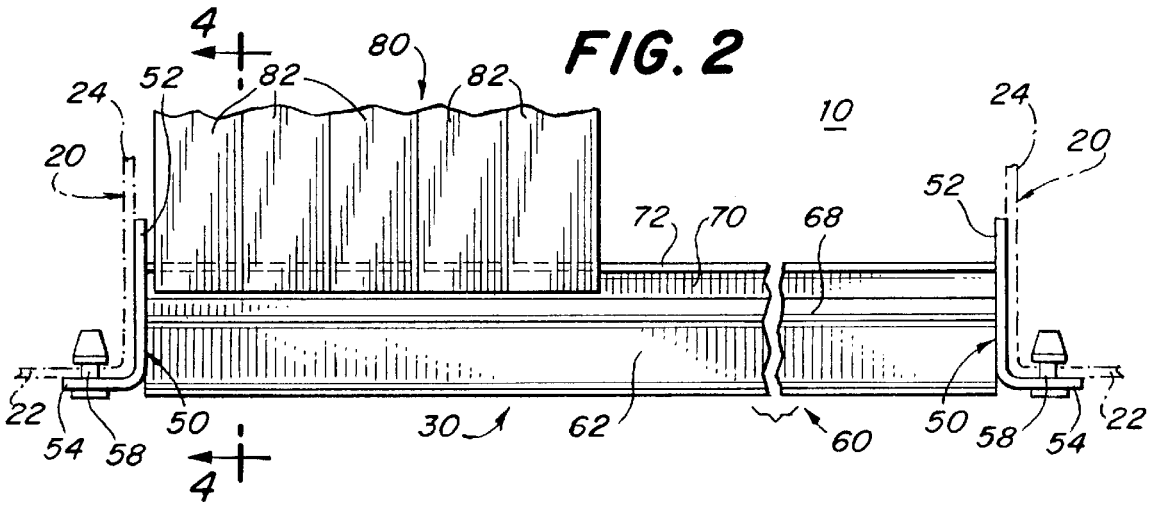
FIG. 2, on a smaller scale, is a top plan of the support beam shown in FIG. 1. Two front columns, one being the front column shown in FIG. 1, are shown in broken lines.
Figure 3:
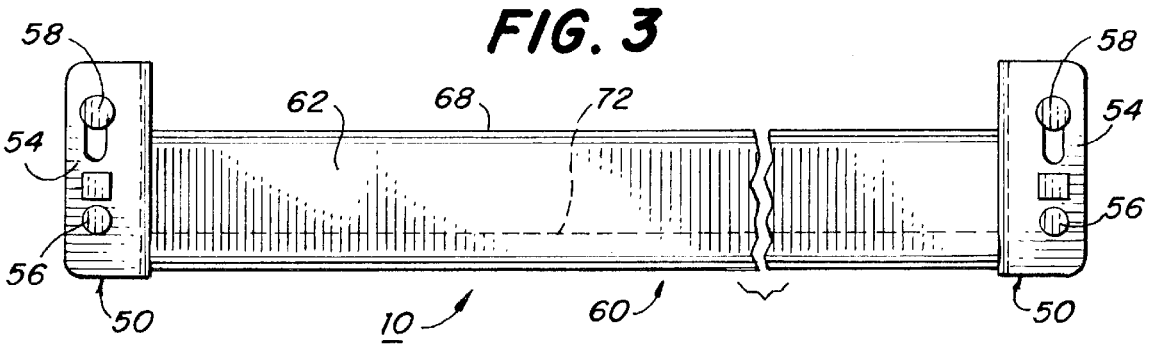
FIG. 3, on a similar scale, is a front elevation of the support beam shown in FIGS. 1 and 2.

As shown fragmentarily in FIGS. 1 through 5, a storage rack 10 constituting a preferred embodiment of this invention comprises, at a front region that faces an aisle, two steel columns 20 and a steel beam 30, which extends between and is supported by the columns 20. Each column 20 is box-like in cross-section and has an outer wall 22 facing outwardly, a side wall 24 facing the side wall 24 of the other column 20, and a side wall (not shown) facing oppositely. The outer wall 22 of each column 20 has two vertical arrays of similar, regularly spaced, modified keyhole-shaped, apertures 26. Each aperture 26 is wider at an upper region of such aperture 26 and narrower at a lower region of such aperture 26.

Figure 4:
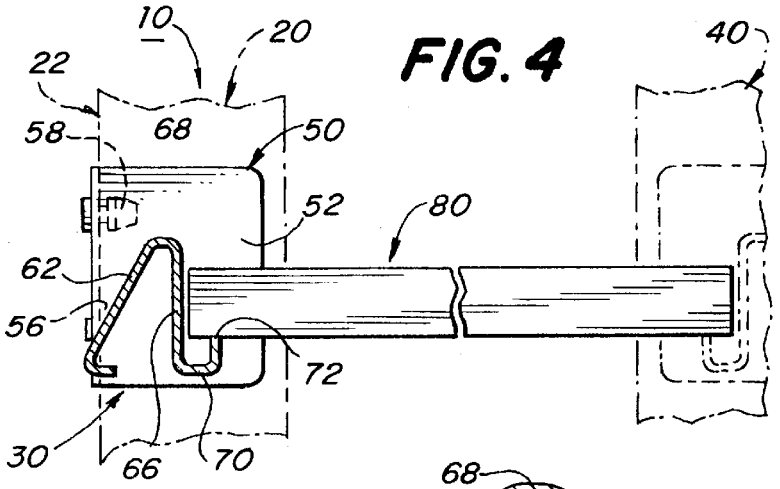
FIG. 4, on a similar scale, is a sectional view taken along line 4—4 of FIG. 2, in a direction indicated by arrows. The front column shown in FIGS. 1 and 2 and a rear column of the storage rack are shown in broken lines.
Figure 5:
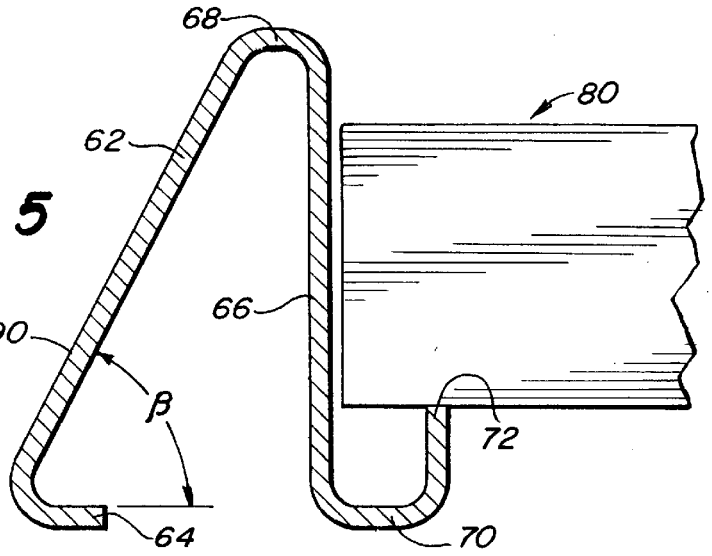
FIG. 5, on a larger scale compared to FIG. 1, is a fragmentary detail taken from FIG. 4.

The columns 20 are disposed at two opposite sides of a bay, which may be one of multiple bays of the storage rack 10 and which may have multiple tiers, and the beam 30 is disposed at a front edge of such a tier. As shown in FIG. 4, the storage rack 10 comprises, at a rear region that also may face an aisle, two similar columns 40 (one shown) disposed at the opposite sides of the same bay and a similar beam 40 disposed at the rear edge of the same tier. The columns 20, 40, are similar to columns known heretofore, as employed in storage racks available commercially from Unarco Material Handling, Inc. of Springfield, Tenn.

The steel beam 30 includes two flange sections 50 and an intermediate section 60. Being fastened to an associated column 20, 40, each flange section 50 has a side plate 52 and an outer flange 54 unitary with the side plate 52, the side plate 52 being adjacent to and partially covering the side wall 24 of the associated column 20, 40, and the outer flange 54 being adjacent to and partially covering the outer wall 22 of the associated column 20, 40.

Preferably, each flange section 50 is connected to the associated column 20, 40, by a connecting pin 56 and is latched thereto by a latching pin 58, as disclosed in an allowed, commonly owned application, U.S. patent application Ser. No. 08/405,509, which was filed on Mar. 16, 1995, now U.S. Pat. No. 5,624,045 and the disclosure of which is incorporated herein by reference. Alternatively, each flange section 50 is fastened to the associated column 20, 40, in any other manner known heretofore for fastening a flange section of a front or rear beam to a column in a storage rack, possibly by wedge connectors (not shown) of a type disclosed in Klein U.S. Pat. No. 4,712,696 or of a type disclosed in Klein U.S. Pat. No. 4,741,445 or by connector bolts (not shown) of a type disclosed in Highsmith U.S. Pat. No. 4,496,061 or of a type disclosed in Klein U.S. Pat. No. 5,020,678.

The intermediate section 60 is rolled from a steel sheet and defines a downwardly opening channel profile without a welded seam extending along the intermediate section 60. As shown in cross-section in FIG. 5, the intermediate section 60 has an outer wall 62, which has a lower flange 64 extending inwardly, an inner wall 66, which is generally vertical and which is joined unitarily with the outer wall 62 so as to define an upper edge 68 of the downwardly opening channel profile, and a lower flange 70, which extends inwardly and upwardly from a lower portion of the inner wall 66. The lower flange 70 has an upturned edge 72, which is spaced below the upper edge 68 and which is continuous along the intermediate section 60, between the flange sections 50.

The storage rack 10 also comprises a deck 80, which may be flat-bottomed and which is supported on the upturned edge 72 of the lower flange 70, between the side plates 52 and behind the inner wall 66. The inner wall 66 provides means for confining the deck 80 against outward movement. The side plates 52 provide means for confining the deck 80 against side-to-side movement.

As shown in FIGS. 1 through 5, the deck 80 is comprised of wooden boards 82 (e.g. so-called "two-by-fours") laid in side-by-side relation to one another, so that each of the sidemost boards 82 is close to a nearer one of the side plates 52. Alternatively, the deck 80 is a plywood or presswood sheet, a resin deck, a sheet of expanded steel, a sheet of so-called "V-deck", which is a type of steel deck used in storage rack systems, or the deck 80 may be a welded mesh or grid of steel wires, of steel strips, or of steel wires and steel strips, which mesh or grid may lap over the upturned edge and hook into the gap between the upturned edge 72 and the inner wall 66.

As shown in FIGS. 1 through 5, the outer wall 62 of the intermediate section 60 is inclined at an angle β in a range from about 20° to about 70° relative to a horizontal plane, so as to extend downwardly and outwardly from the upper edge 68 of the intermediate section 60 and so as to define an expansive surface 90 facing upwardly and outwardly at a complementary angle relative to a horizontal plane. Preferably, the outer wall 62 is inclined at an angle β of about 60° relative to a horizontal plane, as shown.

Figure 6:
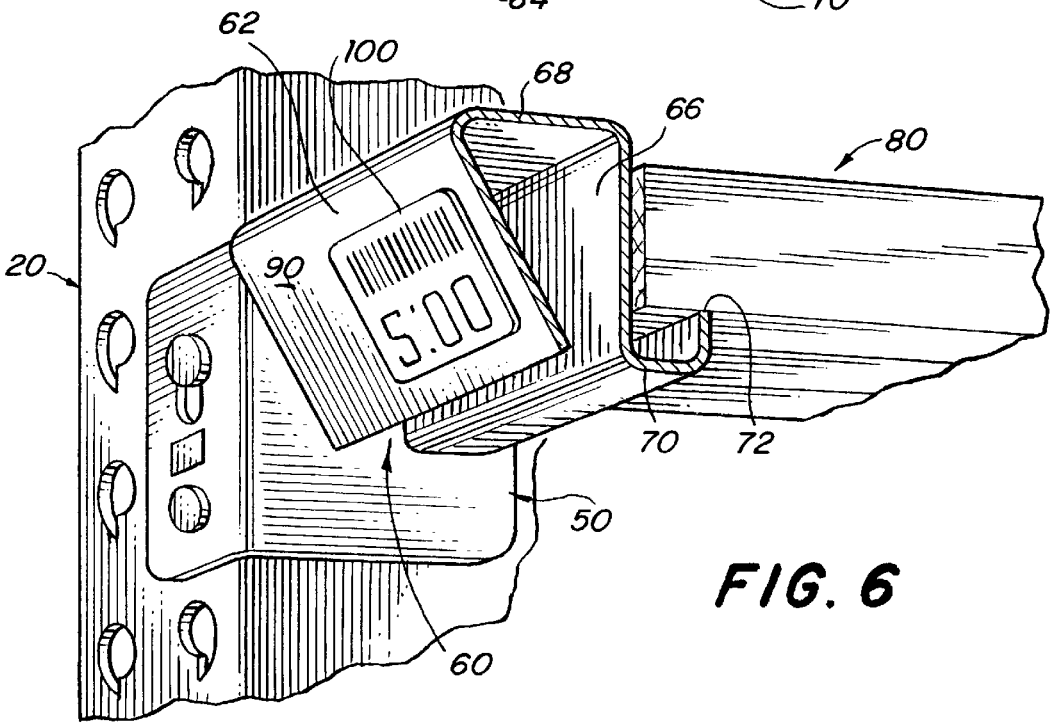
FIG. 6 is a fragmentary, perspective view of a front column, one flange structure of a support beam, an intermediate structure of the support beam, and a wooden deck, as utilized in a storage rack constituting an alternative embodiment of this invention.

As shown in FIG. 6, in an alternative embodiment of this invention, the lower flange 64 of the preferred embodiment is eliminated. Moreover, the outer wall 62 of the intermediate section 60 is inclined at an angle in a range from about 20° to about 70° relative to a horizontal plane, so as to extend downwardly and inwardly from the upper edge 68 of the intermediate section 60 and so as to define an expansive surface 90 facing downwardly and outwardly at a complementary angle relative to a, horizontal plane.

In either of the preferred and alternative embodiments, the expansive surface 90 defined by the outer wall 62 of the intermediate section 60 is adapted to receive indicia, such as alphanumerics and bar codes, via labelling or stencilling. In the preferred embodiment, as shown in FIG. 1, and in the alternative embodiment, as shown in FIG. 6, a label 100 displaying alphanumerics and a bar code is applied adhesively to the expansive surface 90.

In the preferred embodiment, which is useful especially at levels below eye level, and in the alternative embodiment, which is useful especially at levels above eye level, indicia on the label 100 can be easily read by a person standing near the storage rack 10. He or she has a line-of-sight that may be perpendicular to the label 100, whereas he or she would have a line-of-sight that would be oblique to a label on a vertical surface above or below eye level for him or her.

Various modifications may be made to the preferred and alternative embodiments described above without departing from the scope and spirit of this invention.

I claim:

1. A storage rack comprising (a) two columns, each said column having an outer wall facing outwardly and a side wall facing the side wall of the other column, and (b) a steel beam extending between and supported by the columns, the beam including two flange sections and an intermediate section, each flange section being fastened to an associated one of the columns, each flange section having a side plate adjacent to the side wall of the associated one of the columns and an outer flange adjacent to the outer wall of the associated one of the columns, the intermediate section extending horizontally between the flange sections, the intermediate section having two opposite ends and being welded at each of the opposite ends to the side flange of an associated one of the flange sections, the intermediate section being rolled from a steel sheet and defining a downwardly opening channel profile, the intermediate section having an outer wall, an inner wall being generally vertical and being joined unitarily to the outer wall so as to define an upper edge of the downwardly opening channel profile, and a lower flange extending inwardly from a lower portion of the inner wall, the lower flange having an upturned edge spaced below the upper edge of the intermediate section, wherein the upturned edge provides means for supporting a deck on the upturned edge, between the side plates and behind the inner wall, wherein the inner wall provides means for confining such a supported deck against outward movement, and wherein the side plates provide means for confining such a supported deck against side-to-side movement.

2. The storage rack of claim 1 wherein the outer wall of the intermediate section is inclined so as to extend downwardly and outwardly and so as to define an expansive surface facing upwardly and outwardly, the expansive surface being adapted to receive indicia via labelling or stencilling.

3. The storage rack of claim 2 wherein the outer wall of the intermediate section has a lower flange extending inwardly from the inclined portion.

4. The storage rack of claim 1 wherein the outer wall of the intermediate section is inclined so as to extend downwardly and inwardly and so as to define an expansive surface facing downwardly and outwardly, the expansive surface being adapted to receive indicia via labelling or stencilling.

5. A storage rack comprising (a) two columns, each said column having an outer wall facing outwardly and a side wall facing the side wall of the other column, (b) a steel beam extending between and supported by the columns, the beam including two flange sections and an intermediate section, each flange section being fastened to an associated one of the columns, each flange section having a side plate adjacent to the side wall of the associated one of the columns and an outer flange adjacent to the outer wall of the associated one of the columns, the intermediate section extending horizontally between the flange sections, the intermediate section having two opposite ends and being welded at each of the opposite ends to the side flange of an associated one of the flange sections, the intermediate section being rolled from a steel sheet and defining a downwardly opening channel profile, the intermediate section having an outer wall, an inner wall being generally vertical and being joined unitarily to the outer wall so as to define an upper edge of the downwardly opening channel profile, and a lower flange extending inwardly from a lower portion of the inner wall, the lower flange having an upturned edge spaced below the upper edge of the intermediate section, and (c) a deck having an upper surface and a lower surface, the deck being supported at the lower surface by and on the upturned edge of the lower flange of the intermediate section, the upper surface being spaced below the upper edge of the intermediate section, the deck being confined by the inner wall of the intermediate section, so as to restrict outward movement of the deck, and by the side plates of the flange sections, so as to restrict side-to-side movement of the deck.

6. The storage rack of claim 5 wherein the outer wall of the intermediate section is inclined so as to extend downwardly and outwardly and so as to define an expansive surface facing upwardly and outwardly, the expansive surface being adapted to receive indicia via labelling or stencilling.

7. The storage rack of claim 6 wherein the outer wall of the intermediate section has a lower flange extending inwardly from the inclined portion.

8. The storage rack of claim 5 wherein the outer wall of the intermediate section is inclined so as to extend downwardly and inwardly and so as to define an expansive surface facing downwardly and outwardly, the expansive surface being adapted to receive indicia via labelling or stencilling.

* * * * *